US006076923A

United States Patent [19]

Kashimura et al.

[11] Patent Number: 6,076,923

[45] **Date of Patent: *Jun. 20, 2000**

[54] RECORDING APPARATUS

[75] Inventors: Makoto Kashimura; Shinji Kanemitsu, both of Yokohama; Makoto Takemura, Tokyo; Toshiyuki Ohnishi; Tetsuhiro Nitta, both of Yokohama; Yasuhiro Unosawa, Tokyo; Satoshi Saikawa, Inagi; Hiroshi Yoshino, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/928,745

[22] Filed: Sep. 12, 1997

Related U.S. Application Data

[63] Continuation of application No. 08/300,455, Sep. 2, 1994, abandoned.

[30] Foreign Application Priority Data

Sep. 3, 1993 [JP] Japan ..... 5-219334

[51] Int. Cl.[7] ..... B41J 2/01

[52] U.S. Cl. ..... 347/108; 361/681

[58] Field of Search ..... 347/108; 361/681, 361/682

[56] References Cited

U.S. PATENT DOCUMENTS

| | | | |
|---|---|---|---|
| 3,884,342 | 5/1975 | Mulholland . | |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,962,390 | 10/1990 | Yoshimura et al. . | |
| 5,017,033 | 5/1991 | Hermann et al. . | |
| 5,087,932 | 2/1992 | Chikano . | |
| 5,122,005 | 6/1992 | Kamei . | |
| 5,209,583 | 5/1993 | Lewis et al. . | |
| 5,214,429 | 5/1993 | Greenberger . | |
| 5,436,652 | 7/1995 | Mizoguchi et al. | 347/108 |

FOREIGN PATENT DOCUMENTS

| | | |
|---|---|---|
| 0219624 A2 | 4/1987 | European Pat. Off. . |
| 0271090 A2 | 6/1988 | European Pat. Off. . |
| 0418740 A2 | 3/1991 | European Pat. Off. . |
| 0442726 A2 | 8/1991 | European Pat. Off. . |
| 0447162 A1 | 9/1991 | European Pat. Off. . |
| 0451828 A2 | 10/1991 | European Pat. Off. . |
| 0454415 A2 | 10/1991 | European Pat. Off. . |
| 0501789 A2 | 9/1992 | European Pat. Off. . |
| 0549989 A3 | 7/1993 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 61-084253 | 4/1986 | Japan . |
| 63-031759 | 2/1988 | Japan . |
| 3142253 | 6/1991 | Japan . |
| 3-224772 | 10/1991 | Japan . |
| 4022670 | 1/1992 | Japan . |

*Primary Examiner*—Valerie Lund
*Attorney, Agent, or Firm*—Fitzpatrick, Cella, Harper & Scinto

[57] ABSTRACT

To assure that the space efficiency of a recording apparatus can be improved, the length of each of cables to be electrically connected to a mechanism section can be optimized, and the recording apparatus having excellent handling properties can be produced with small dimensions at a reduced cost, a controlling section for controlling a mechanism section substantially composed of an automatic feeding section, a conveying section, a discharging section and a recording section, each of which is associated with a recording operation to be performed by the recording apparatus, is arranged above the mechanism section.

15 Claims, 7 Drawing Sheets

RECORDING APPARATUS

This application is a continuation of Application Ser. No. 08/300,455 filed Sep. 2, 1994, now abandoned.

BACKGROUND OF THE INVENTION

1. Field of the Invention

The present invention relates generally to a recording apparatus. More particularly, the present invention relates to a recording apparatus of the type mainly usable for outputting recording information representing a character, an image or the like onto a recording medium.

2. Description of the Related Art

In recent years, since a so-called note type personal computer has been developed to a level sufficient for practical use, a variety of further development works are positively conducted for providing the note type personal computer having a higher functional capability with smaller dimensions. In addition, since a recording operation can be performed with the note type personal computer by using plural kinds of colored inks owing to the successful development of a colored liquid crystal display, and moreover, each note type personal computer can be produced at a reduced cost, a number of note type personal computers have been heretofore shipped to a commercial market for a short period of time. In the circumstances as mentioned above, many sincere requests have been raised from many users for providing a recording apparatus, i.e., a typical peripheral equipment for the personal computer which assures that a color recording operation can be performed therewith, and moreover, it can be designed and constructed with smaller dimensions at a reduced cost while exhibiting improved handling properties. To sufficiently satisfy these requests, many proposals have been made for providing various kinds of recording apparatus having an ink jet process employed therefor in association with a note type personal computer of the foregoing type.

A conventional recording apparatus is substantially composed of a carriage driving section for reciprocably displacing a carriage having a recording head mounted thereon, a conveying section for conveying a recording medium across the recording apparatus, a controlling section for processing data and information outputted from the personal computer so as to drive the recording head, the carriage driving section and the conveying section for forming characters, images or the like on the recording medium, and a power source for feeding electricity to the recording head, the carriage driving section, the conveying section and the controlling section, and each of the aforementioned sections constituting the conventional recording apparatus is accommodated as a unit in a common casing for the conventional recording apparatus.

However, the carriage driving section, the conveying section, the controlling section and the power source are not always arranged at their optimum positions in the casing. For this reason, the length of each of flexible wiring boards and cables for electrically connecting the carriage driving section, the conveying section and the power source to each other is unavoidably elongated. In addition, a wide useless space is undesirably formed in the casing. Consequently, the whole structure of the conventional recording apparatus is unfavorably enlarged, resulting in the conventional recording apparatus being fabricated at an increased cost. Further, the conventional recording apparatus has a few problems to be solved, and one of the problems to be solved is that the conventional recording apparatus exhibits poor handling properties.

For example, a control board for controlling a recording operation to be performed with the conventional recording apparatus is arranged on the bottom wall of the casing or below the scanning range where the recording head is adapted to reciprocably move. In this case, there arises a malfunction that the length of each of cables for electrically connecting the control board to mechanism sections is elongated. Especially, with respect to the conventional recording apparatus having an ink jet recording system employed therefor, in addition to the aforementioned problems, there is a possibility of ink leaks from the recording head in the course of each recording operation. To cope with the problem that ink leaks in that way, a wall or a similar member is arranged upright in the vicinity of the control board for the purpose of preventing leaked ink from flowing to the control board side. However, it has been confirmed that the upright arrangement of the wall can not completely prevent the leaked ink from flowing to the control board side. For this reason, the arrangement of the control board below the scanning range where the recording head reciprocably moves is one of the problems to be solved with respect to the conventional recording apparatus.

SUMMARY OF THE INVENTION

The present invention has been made in consideration of the aforementioned background.

An object of the present invention is to provide a recording apparatus which assures that the space utilizing efficiency of the recording apparatus can be improved, and moreover, the length of each of cables such as flexible wiring board, lead wires or the like to be electrically connected to essential components constituting the recording apparatus can be optimized.

Another object of the present invention is to provide a recording apparatus which assures that a recording operation to be performed by the recording apparatus is hardly adversely affected by a malfunction such as ink leakage or the like and which is constructed with smaller dimensions while exhibiting excellent handling properties.

The present invention provides a recording apparatus including a mechanism section for achieving a recording operation therewith, wherein a controlling section for controlling the mechanism section is located above the region where the mechanism section is arranged.

Since the controlling section is located above the region where the mechanism section is arranged in the above-described manner, the length of each cable such as a flexible wiring board, a lead wire or the like for electrically connecting the controlling section and the mechanism section to each other can be optimized. In addition, since the space efficiency of the recording apparatus can be improved, the recording apparatus having excellent handling properties can be constructed with small dimensions at a reduced cost.

Further, since the controlling section is located above the mechanism section, there does not arise a malfunction that leaked ink flows down onto the controlling section. Consequently, the present invention can provide a recording apparatus having high reliability.

The above and other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings, i.e., FIG. 1 to FIG. 8 which illustrate a preferred embodiment thereof.

First, the structure of each of essential components constituting a portable type ink jet recording apparatus constructed in accordance with the embodiment of the present invention will be described below with reference to FIG. 1 and FIG. 2. It should be noted that the ink jet recording apparatus constructed with small dimensions in accordance with the embodiment of the present invention can portably be held in such a manner that it can easily be carried to any desired location as will be described later.

Figure 1:
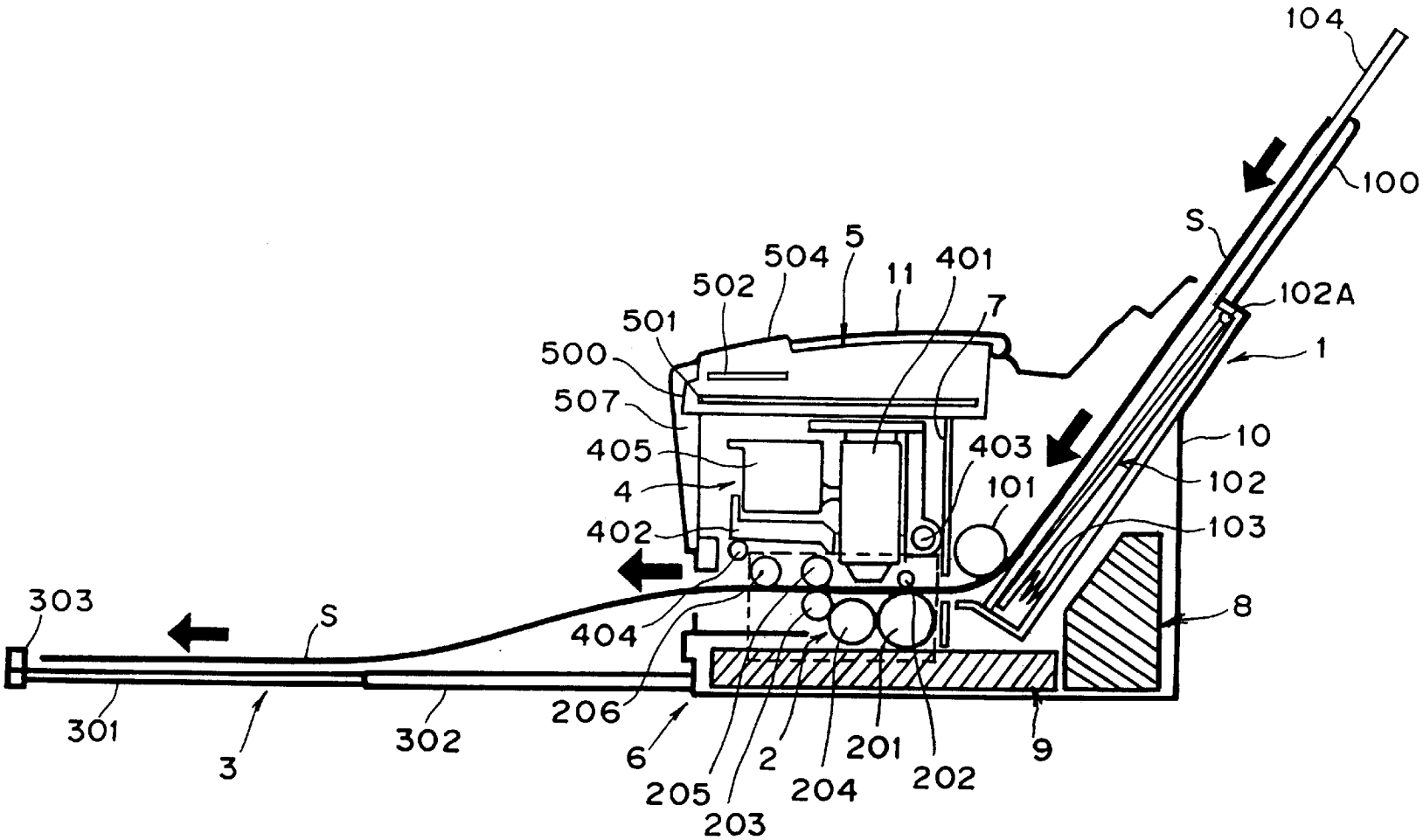
FIG. 1 is a sectional view which schematically shows the structure of a recording apparatus constructed in accordance with an embodiment of the present invention.
Figure 2:
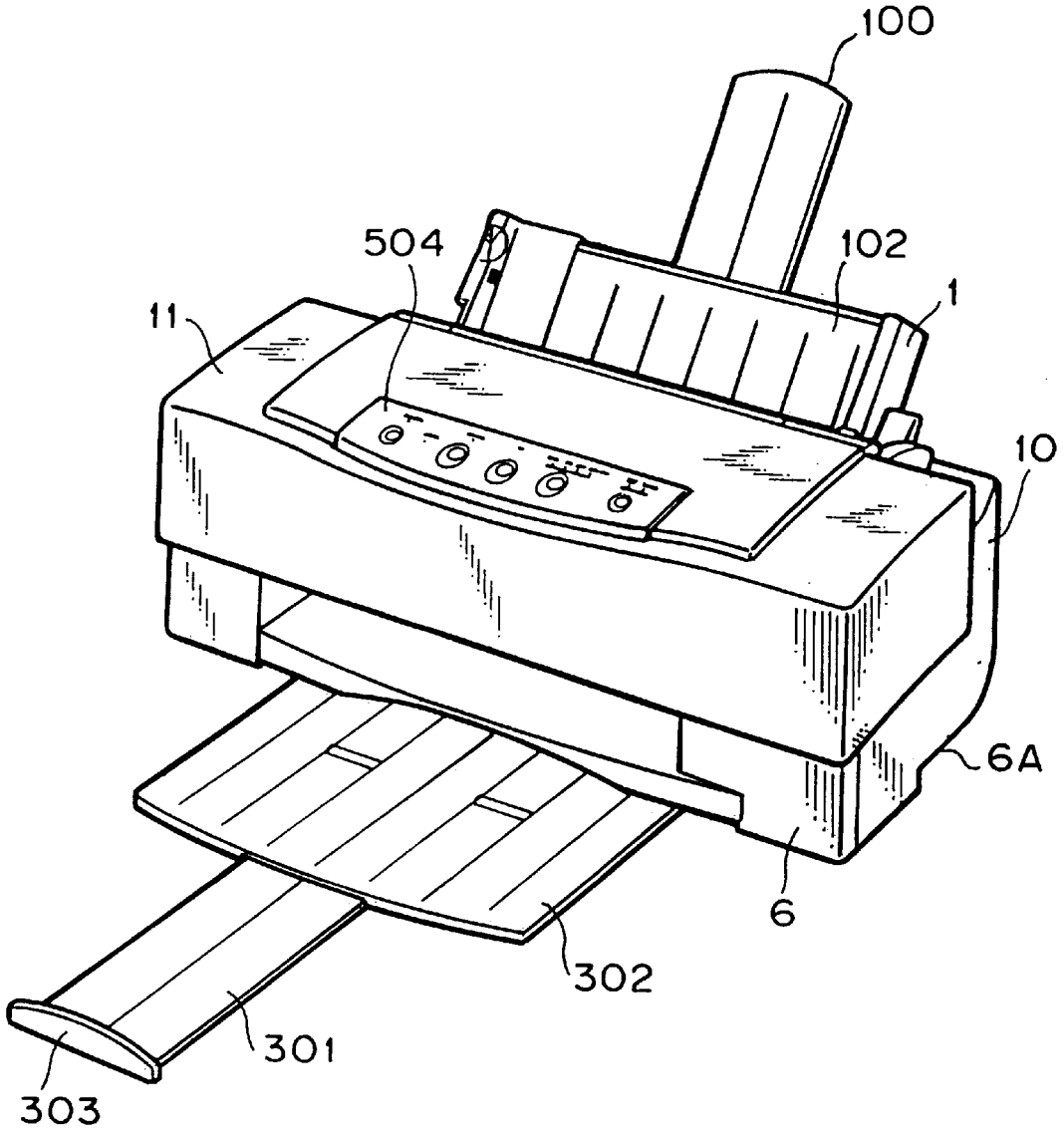
FIG. 2 is a perspective view which shows an appearance of the recording apparatus constructed in accordance with the embodiment of the present invention.

In FIG. 1, reference numeral 1 designates an automatic feeding section in which plural sheets of recording papers S are held in the piled state so as to enable them to be automatically successively fed to a recording position one by one. Reference numeral 2 designates a conveying section which serves to conduct a sheet of recording paper S selectively fed from the automatic feeding section 1 by a separating roller 101 to a recording position, and subsequently, conduct the recorded sheet of recording paper S to a discharging section 3. Reference numeral 4 designates a recording section. In the shown case, the recording section 4 includes as essential components an ink jet head 401 (adapted to eject four kinds of inks, i.e., yellow ink, magenta ink, cyan ink and black ink for performing a color recording operation with the ink jet recording apparatus constructed in accordance with the embodiment of the present invention), a carriage 402 having the ink jet head 401 mounted thereon, guide shafts 403 and 404 each serving to guide the movement of the carriage 402 in the perpendicular direction relative to the plane of FIG. 1 with the aid of a timing belt (not shown), a plurality of ink tanks 405 for feeding four kinds of colored inks to the ink jet head 401 therefrom, and a carriage driving section (not shown) for scanning the carriage 402 while reciprocably displacing the same. Reference numeral 5 designates a controlling section which serves to control the whole ink jet recording apparatus based on recording data and information outputted from a host computer (not shown).

Figure 3:
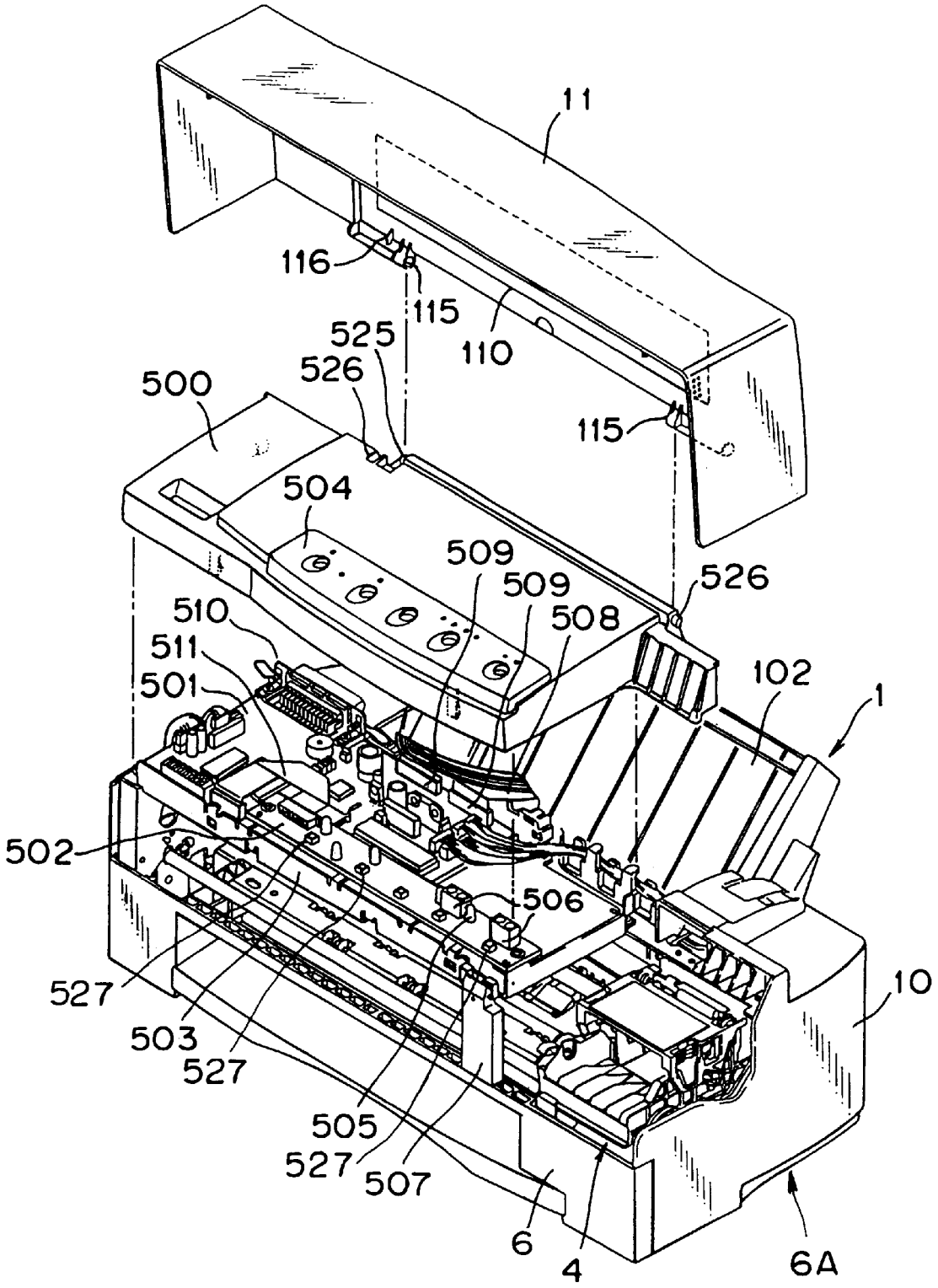
FIG. 3 is a perspective view which shows other appearance of the recording apparatus constructed in accordance with the embodiment of the present invention in the disassembled state.

The controlling section 5 is covered with an inner cover 500. As shown in FIG. 3, a control board 501, a panel board 502 and a shield plate 503 for preventing noise from emanating outside of the inner cover 500 are accommodated in the inner cover 500. Reference numeral 504 designates an operation panel which is projected from above the upper surface of the inner cover 500. As is apparent from FIG. 3, the operation panel 504 is arranged directly above the panel board 502. A plurality of light emitting diodes 505 and a plurality of panel switches 527 are disposed on the panel board 502. The shield plate 503 is required to exhibit a sufficiently excellent shielding effect. Since a certain intensity of actuating force is applied to the operation panel 504 when the panel switch 527 is actuated, it is desirable that the shield plate 503 is made of a metallic plate which can satisfactorily stand against the actuating force. Reference numeral 507 designates a support column for supporting the shield plate 503 on a lower case 6. With such construction, the whole control section 5 is supported on the recording section 4 together with the shield plate 503 and the control board 501 with the aid of the support column 507 and a chassis 7 (see FIG. 1).

Next, other essential components constituting the ink jet recording apparatus rather than the aforementioned ones will be described below.

The automatic feeding section 1 is attached to the chassis 7. As shown in FIG. 1, the automatic feeding section 1 is substantially composed of a sheet receiver 100 comprising an expansible/contractible receiving plate and a thrusting plate 102 of which upper end part is turnably supported by a pivotal shaft 102A and of which lower end part is normally biased toward a separating roller 101 by the resilient force of a thrusting spring 103. As the separating roller 101 operatively associated with a feeding roller 201 via a row of gears and driving force shifting means (both of which are not shown in the drawing) is rotated, one of the sheets S are successively fed one by one from among a pile 104 of sheets S placed on the sheet receiver 100.

The conveying section 2 is substantially composed of an assembly of feeding roller 201 and pinch roller 202 for conducting the sheet S fed from the automatic feeding section 1 by the rotation of the separating roller 101 to the position facing to an ink ejecting surface of the ink jet head 401, a power transmitting roller 204 for transmitting the driving force of the feeding roller 201 to a sheet discharging roller 203, and a pair of tractor wheels 205 and 206 rotatably supported by coil springs (not shown).

The discharging section 3 is substantially composed of two trays 301 and 302 each capable of being expanded or contracted corresponding to the length of each sheet S delivered from the conveying section 2. To assure that two kinds of sheet S, e.g., one of them being a sheet having a length ranging from 279 mm to 297 mm corresponding to an A-4 letter size and the other one being a sheet having a length of 355 mm corresponding to a legal size, can correctly be located in the discharging section 3, a clicking mechanism (not shown) is arranged on the discharging section 3. As is apparent from FIG. 4, when no recording operation is performed with the ink jet recording apparatus, the trays 301 and 302 are contractibly accommodated in the lower case 6. Referring to FIG. 1 again, reference numeral 8 designates a power source section, and reference numeral 9 designates a discharged ink tank in which the ink discharged from the ink jet head 401 for the purpose of achieving a recovering operation is received. In addition, reference numeral 10 designates a rear cover, and reference numeral 11 designates a top cover which serves to cover the upper part of whole recording apparatus from above the control section 5 therewith with the exception of the operation panel 504.

Next, the structure of each of the control section 5 and the top cover 11 disposed above the control section 5 will be described below with reference to FIG. 3 and FIG. 4.

Reference numeral 508 designates a flexible wiring cable which is electrically connected to a connector 509 for the control board 501 in order to feed a series of signals representing data to the ink jet head 401. Reference numeral 510 designates an interface connector which serves to receive and deliver a series of signals representing data and information between the control board 501 and an external host unit (not shown). In addition, connectors used for performing a wiring operation in order to electrically connect to the control board 501 a sheet feeding motor, a carriage driving motor, a sheet detecting sensor, a carriage home position sensor and other sensors each of which is not shown in the drawings, a connector used for electrically connecting the power source to the control board 501 and other connectors are arranged on the control board 501.

According to the present invention, since the automatic feeding section 1, the conveying section 2, the discharging section 3, the recording section 4 and the controlling section 5 can be arranged at the optimum positions in the ink jet recording apparatus, the ink jet recording apparatus can be constructed with small dimensions without any necessity for uselessly extending cables by a long distance, resulting in the ink jet recording apparatus being produced not only at an increased high space utilization efficiency but also at a reduced cost. In addition, since the controlling section 5 is surrounded by the inner cover 500 and the shield plate 503, it is assured that the control section 5 is effectively protected from the mist particles generated as ink is ejected from the ink jet head 401.

In this embodiment, the inner cover 500 is attached to the ink jet recording apparatus in such a manner as to cover the control board 501 and the panel board 502 along the shield plate 503 therewith.

Next, the structure for operatively connecting the inner cover 500 to the top cover 11 serving to openably cover the inner cover 500 therewith will be described below with reference to FIG. 3 and FIG. 4. In the drawings, reference numeral 525 designates a shaft which is projected outside of the opposite end edges of a main body of the inner cover 500, and reference numeral 526 designates an engagement groove which is recessed at the position in the vicinity of one end edge of the main body of the inner cover 500. Reference numeral 115 designates a shaft support portion which is disposed in the top cover 11 so as to allow the shaft 525 to be fitted thereto, and reference numeral 116 designates an engagement pawl capable of being engaged with the engagement groove 526 of the inner cover 500. While the engagement pawls 116 are engaged with the engagement grooves 526, the engagement pawls 116 serve to properly locate the top cover 11 on the ink jet recording apparatus, and moreover, they can easily open the top cover 11 via engagement of the engagement pawls 116 with the engagement grooves 526. As is best seen in FIG. 4, the top cover 11 is attached to the ink jet recording apparatus in such a manner as to enable it to be freely opened or closed on the main body of the ink jet recording apparatus.

Reference numeral 110 designates an opening portion which is formed through the top cover 11. When the top cover 11 is fitted onto the main body of the ink jet recording apparatus in a covering manner, the operation panel 504 is exposed to the outside via the opening portion 110. With such construction, since the operation panel 504 can be actuated with user's fingers via the opening portion 504 regardless of whether the top cover 11 is kept opened or closed, it can easily be confirmed how a cleaning operation is performed for the ink jet head 401 while a user actuates each of the components in the mechanism section in the ink jet recording apparatus via the operation panel 504.

Figure 4:
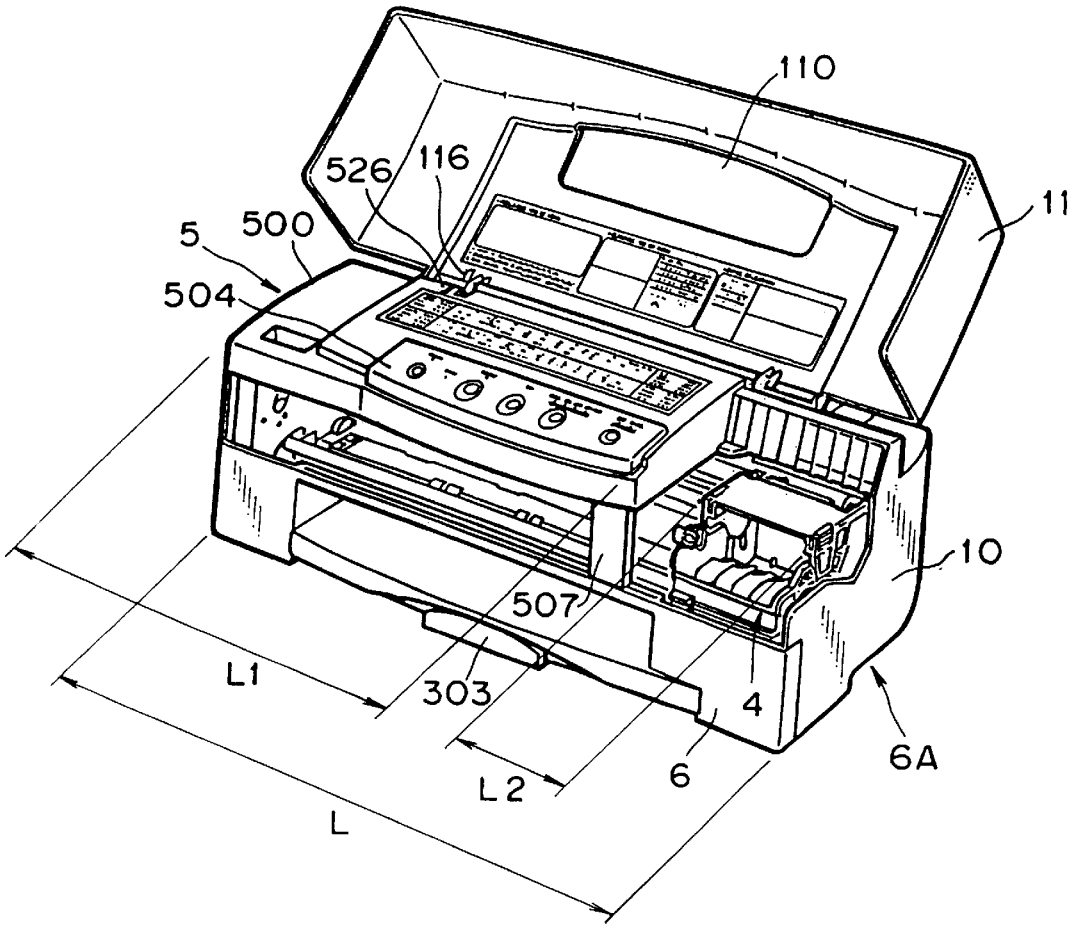
FIG. 4 is a perspective view which shows another appearance of the recording apparatus constructed in accordance with the embodiment of the present invention wherein a top cover of the recording apparatus is kept open.

To assure that the ink jet head 401 and each of the ink tanks 405 can be attached to and detached from the carriage 402 of the recording section 4 while the top cover 11 is kept opened as shown in FIG. 4, a width L1 of the controlling section 5 relative to the whole width L of the ink jet recording apparatus is restrictively determined in conformity with the following inequality (1).

$$L1<L-L2 \quad (1)$$

where L2 represents a width of the carriage 402.

While the ink jet head 401 is held in the standby state that it waits for next recording data to be fed thereto after completion of a preceding recording operation, a protective cap of the ink jet head 401 is kept open at the position where the ink jet head 401 is located at the standby position in order to shorten a predetermined period of time (about 60 seconds) until a next recording operation is started. Once the relationship as defined by the inequality (1) is satisfactorily established, the position assumed by the carriage 402 held in the standby state is located downward of the controlling section 5. While the foregoing positional state is maintained, it is impossible to attach and detach the ink jet head 401 and the ink tanks 405 from above the carriage 402. Consequently, there does not arise a malfunction that a user erroneously detaches the ink jet head 401 and the ink tanks 405 from above the carriage 402 held in the standby state.

Figure 5:
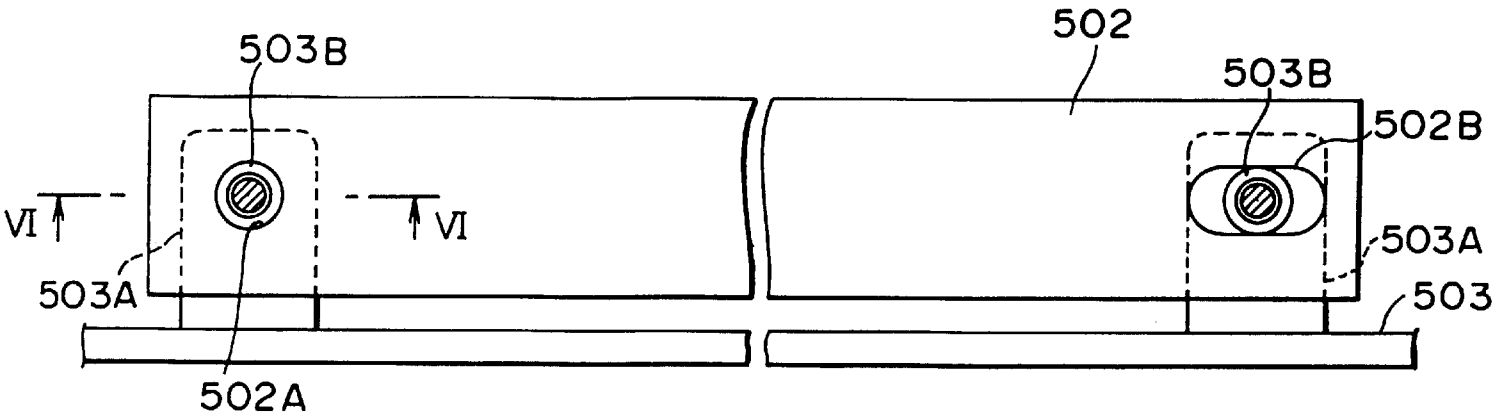
FIG. 5 is a fragmentary enlarged plan view of the recording apparatus, showing on an enlarged scale the connected state that a shield plate is firmly connected to a panel board.
Figure 6:
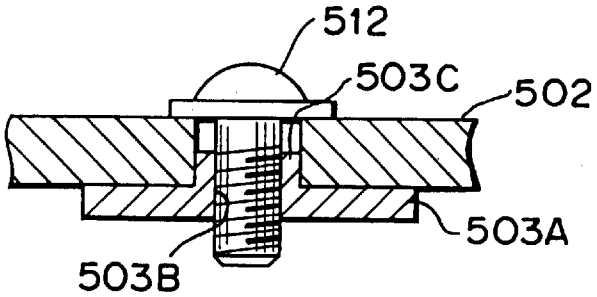
FIG. 6 is a fragmentary enlarged sectional view of the recording apparatus taken along line VI—VI in FIG. 5.

FIG. 5 and FIG. 6 show the structure employable for immovably locating the panel board 2 relative to the shield plate 503. Reference numeral 503A designates a fitting arm which is formed integral with the shield plate 503 while extending in the horizontal direction. Reference numeral 503B designates a female threaded fixing hole which is formed through the fitting arm 530A for the purpose of immovably holding the shield plate 503, and reference numeral 503C designates a barring portion which is projected from the fitting arm 503A around the female threaded fixing hole 503B. A fitting hole 502A and an elongated fitting hole 502B are formed through the panel board 502 at the positions corresponding to the female threaded fixing holes 503B.

When the panel board 502 is immovably fitted to the shield plate 503, first, the barring portions 503C of the fitting arms 503A are fitted into the fitting hole 502A and the elongated fitting hole 502B which are formed through the panel board 502. Subsequently, as shown in FIG. 6, fixing screws 512 are threadably fitted into the female threaded fixing holes 503B so that the panel board 502 is correctly located relative to the shield plate 503, causing it to be immovably held by the shield plate 503. At this time, a part of the control board 501 is likewise correctly located relative to the shield plate 503 and immovably held by the latter.

Figure 7:
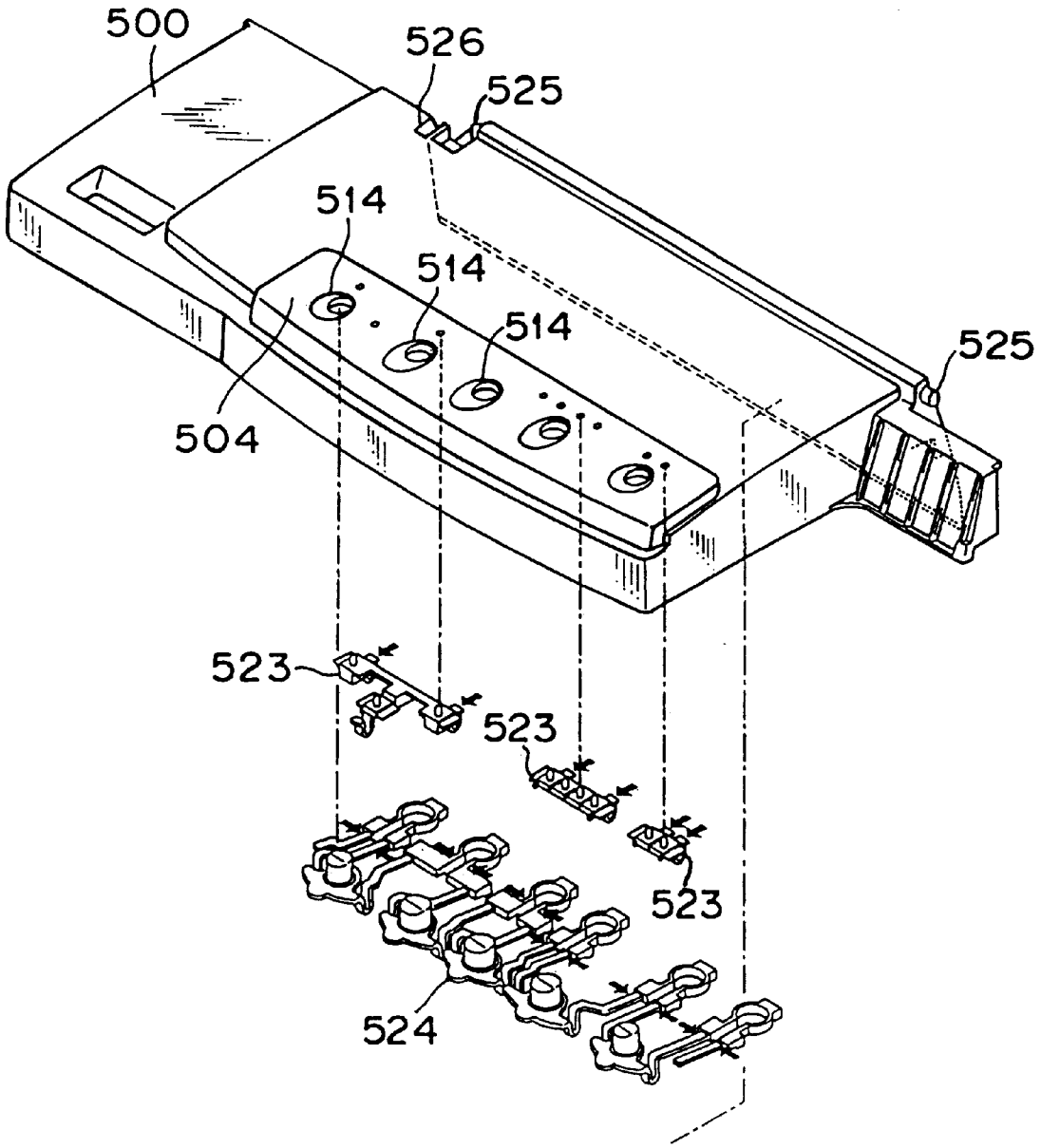
FIG. 7 is a perspective view of the recording apparatus which shows an appearance of a control panel section for the recording apparatus in the disassembled state.

Next, the positional relationship established among a plurality of light guides 523 for the light emitting diodes 505 disposed on the panel board 502, a plurality of panel switch members 524 disposed on the control board 501, and a plurality of key tops 514 disposed on the operation panel 504 of the inner cover 500 arranged in the controlling section 5 of the ink jet recording apparatus of the present invention will be described below with reference to FIG. 7.

Each light shielding material 506 molded of an elastic synthetic resin such as a polyester-polyurethane foam (e.g., MOLTOPREN produced and sold by INOAC CORP.), a rubber or the like is disposed on the light emitting diode 505 located in the vicinity of the panel board 502 in order to prevent a light beam from improperly leaking to the outside. In this embodiment, since an elastic material is employed as a raw material for the light shielding material 506, it is not necessary that the control board 501 and the panel board 502 are held in the ink jet recording apparatus at a high positional accuracy. In addition, since the light shielding material 506 is attached to the light emitting diode 505 by utilizing the elasticity of the light shielding material 506 itself, there is no possibility that the light shielding material 506 falls down away from the light emitting diode 505. This leads to the result that the light shielding material 506 can exhibit an excellent light beam leakage preventive function with simple structure. It should be noted that it is not necessary that a light shielding material 506 is fitted to each of all the light emitting diodes 505 disposed adjacent to each other but the same advantageous effect as mentioned above can be obtained by fitting a light shielding material 506 only to one of the light emitting diodes 505 disposed adjacent to each other. In this embodiment, four light shielding materials 506 are arranged, and the one light shielding material 506 is fitted only to two light emitting diodes 505 located on the inside among four light emitting diodes 505 disposed adjacent to each other.

In practice, each of the light guides 523 serves to properly conduct the light beam generated by each light emitting diode 505 to the operation panel 504 and each light guide 523 molded of a synthetic resin can firmly be fitted to the inner cover 500 by utilizing the elasticity of the light guide 523 itself. In addition, a plurality of key tops 514 arranged on the operation panel 504 are formed integral with the operation panel 504 in such a manner as to allow them to be elastically deformed. With this construction, because of a necessity for preventing adjacent key tops 514 from interfering with each other due to their elastic deformation, the peripheral part of each key top 514 is dimensioned to have a thickness smaller than that of the operation panel 504 itself.

Figure 8:
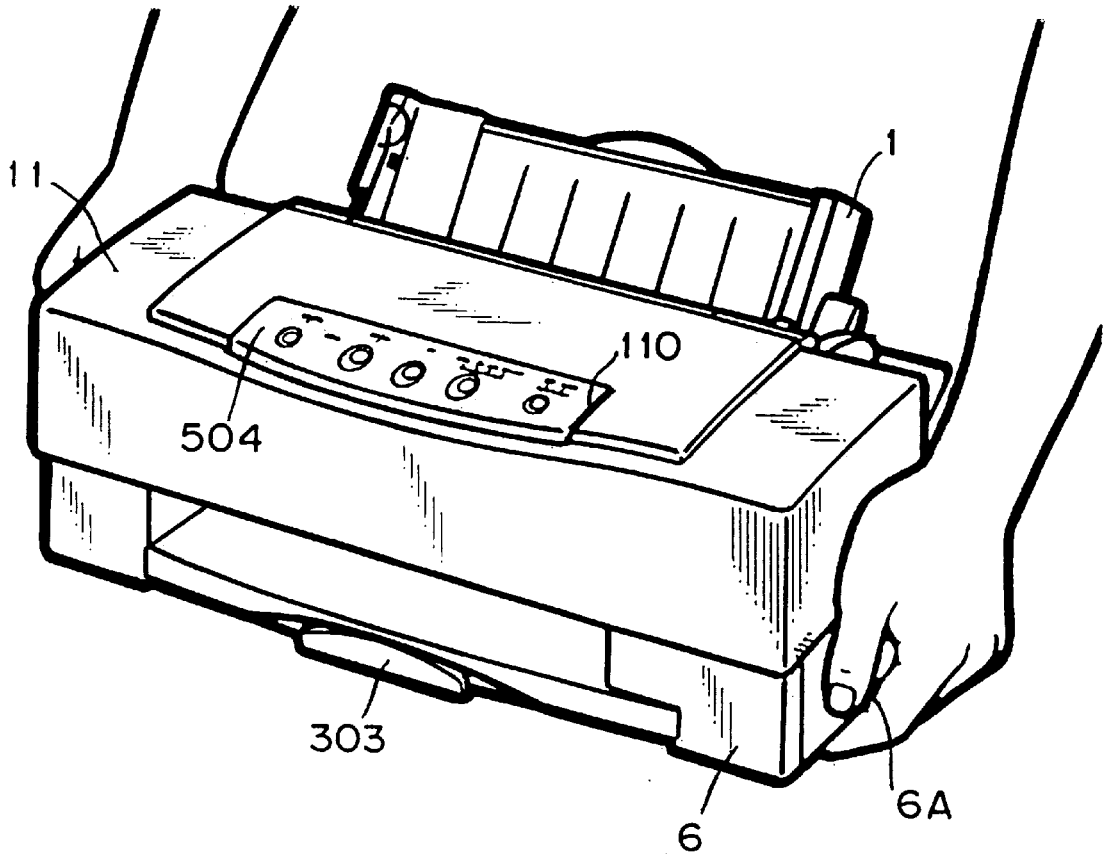
FIG. 8 is a perspective view which shows another appearance of the recording apparatus constructed in accordance with the embodiment of the present invention before it is carried to another location with user's hands.

It should be noted that recesses 6A are formed on the lower surface of the lower case 6 on the opposite sides of the latter, and the central part of each recess 6A is located in a vertically extending plane passing the gravity center of the ink jet recording apparatus. As is best seen in FIG. 8, the recesses 6A can be utilized as hand holding steps when the ink jet recording apparatus is carried to another location with user's hands placed below the recesses 6A. Since the central part of each recess 6A is located in the vertically extending plane passing the gravity center of the ink jet recording apparatus as mentioned above, any user can stably carry the ink jet recording apparatus to his desired location without any occurrence of a malfunction that the ink jet recording apparatus is dangerously tilted after it is lifted up with user's hands.

As is apparent from reading of the above description on this embodiment, since the control board 501 is arranged at the upper part of the ink jet recording apparatus, a sufficiently large area can be reserved for the control board 501 while assuring that the control board 501 effectively exhibits its own function. It should be added that it is possible to increase the area of the control board 501 to such a maximum extent that it is substantially equal to the installation area of the ink jet recording apparatus.

In this embodiment, the control board 501 and the panel board 502 are electrically connected to each other via the flexible wiring board 511 (see FIG. 3). Alternatively, a plurality of pin type connectors may be substituted for the flexible wiring board 511 for the same purpose as mentioned above.

Additionally, in this embodiment, the control board 501 and the panel board 502 are separately arranged in the ink jet recording apparatus. However, in view of the fact that the control board 501 is arranged in the upper part of the ink jet recording apparatus, it is practically possible that a plurality of panel switches 527 and a plurality of light emitting diodes 505 to be fitted to the operation panel 504 are disposed directly on the control board 501, causing the panel board 502 to be eliminated because of no necessity for the panel board 502. Since the ink jet recording apparatus is constructed in that way, a space utilizing efficiency of the ink jet recording apparatus can be increased further, and moreover, the ink jet recording apparatus can be produced at a reduced cost.

Further, in this embodiment, a plurality of light emitting diodes 505 are used to serve as a display section for the ink jet recording apparatus. Alternatively, a liquid crystal display portion may be substituted for the light emitting diodes 505. In the case that the liquid crystal display portion is arranged for the ink jet recording apparatus, properties of the ink jet recording apparatus can be improved further.

The aforementioned embodiment has been described with respect to the case that an ink jet system is employed as a recording system, but the present invention should not be limited only to the ink jet system. It of course is obvious that a thermal image transferring system and a wire dot recording system are equally applicable to the recording apparatus of the present invention.

In the case that the ink jet system is employed for the recording apparatus, since the controlling section is arranged above the mechanism section, there hardly arises a malfunction that ink leaking from the ink jet head flows down onto the controlling section. Consequently, the present invention can provide a recording apparatus having high safety and reliability. In the case that a system for ejecting ink in the downward direction by utilizing the thermal energy generated by a plurality of electrothermal converting elements is employed for carrying out tile present invention, an advantageous effect obtainable from the recording apparatus can remarkably be improved by arranging the controlling section upward of the mechanism section for performing a recording operation, especially, in the region directly above the mechanism section. The reason for this lies in that it is anticipated that heat can uniformly be distributed in the recording apparatus, and moreover, heat can effectively be radiated outside of the recording apparatus, because a plurality of electrothermal converting elements (normally located comparatively near the ejecting ports of the ink jet head) to serve as a main heat generating source for the recording apparatus are disposed comparatively remote from a circuit board in the controlling section of the recording apparatus.

The present invention achieves a distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist ot a plurality ot recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A recording apparatus comprising:

a mechanism section for effecting a recording operation, said mechanism section comprising a carriage for detachably mounting and scanning at least one of an ink jet head and an ink tank storing ink for supply to said ink jet head, driving means for driving said carriage, and recording medium conveying means for conveying a recording medium, wherein said ink jet head is mounted on said carriage such that said ink jet head ejects ink downwardly to the recording medium; and a controlling section for controlling said mechanism section, said controlling section comprising a plurality of circuits, operating means and displaying means, each being used for a controlling operation for said mechanism section, wherein said mechanism section is located only below said controlling section.

2. A recording apparatus according to claim 1, wherein said ink jet head comprises a plurality of electrothermal converting elements as energy generating elements for ejecting the ink therefrom, each of said electrothermal converting elements generating thermal energy for inducing film boiling in the ink.

3. A recording apparatus according to claim 1 or 2, further comprising a casing for said mechanism section and said control section, wherein a sum of a width of said controlling section and a width of said carriage as measured in a scanning direction of said carriage is smaller than a whole width of said casing.

4. A recording apparatus according to claim 1 or 2, further comprising a cover member for being opened and closed, said cover member covering said operating means and said displaying means such that said operating means and said displaying means are externally exposed when said cover member is opened.

5. A recording apparatus according to claim 3, further comprising a cover member for being opened and closed, said cover member covering said operating means and said displaying means such that said operating means and said displaying means are externally exposed when said cover member is opened.

6. A recording apparatus according to claim 3, wherein said casing comprises a pair of recesses formed on opposite sides of a lower surface of said casing as hand grips, a central part of each of said recesses being located on a vertically extending plane passing through a center of gravity of said recording apparatus.

7. A recording apparatus according to claim 4, wherein said casing comprises a pair of recesses formed on opposite sides of a lower surface of said casing as hand grips, a central part of each of said recesses being located on a vertically extending plane passing through a center of gravity of said recording apparatus.

8. A recording apparatus comprising:

a mechanism section for effecting a recording operation, said mechanism section comprising a carriage for detachably mounting and scanning at least one of an ink jet head and an ink tank storing ink for supply to said ink jet head, driving means for driving said carriage, and recording medium conveying means for conveying a recording medium, wherein said ink jet head is mounted on said carriage such that said ink jet head ejects ink to the recording medium; and a controlling section for controlling said mechanism section, said controlling section comprising a plurality of circuits, each being used for a controlling operation for said mechanism section, wherein said mechanism section is located directly below said controlling section.

9. A recording apparatus according to claim 8, wherein said ink jet head comprises a plurality of electrothermal converting elements as energy generating elements for ejecting the ink therefrom, each of said electrothermal converting elements generating thermal energy for inducing film boiling in the ink.

10. A recording apparatus according to claim 8, further comprising a casing for said mechanism section and said controlling section, wherein a sum of a width of said controlling section and a width of said carriage as measured in a scanning direction of said carriage is smaller than a whole width of said casing.

11. A recording apparatus according to claim 10, wherein said casing comprises a pair of recesses formed on opposite sides of a lower surface of said casing as hand grips, a central part of each of said recesses being located on a vertically extending plane passing through a center of gravity of said recording apparatus.

12. A recording apparatus comprising:

a mechanism section for effecting a recording operation, said mechanism section comprising a carriage for detachably mounting and scanning at least one of an ink jet head and an ink tank storing ink for supply to said ink jet head, driving means for driving said carriage, and recording medium conveying means for conveying a recording medium, wherein said ink jet head is mounted on said carriage such that said ink jet head ejects ink to the recording medium; and a controlling section for controlling said mechanism section, said controlling section comprising a plurality of circuits, each being used for a controlling operation for said mechanism section, wherein said controlling section is located directly above said mechanism section.

13. A recording apparatus according to claim 12, wherein said ink jet head comprises a plurality of electrothermal converting elements as energy generating elements for ejecting the ink therefrom, each of said electrothermal converting elements generating thermal energy for inducing film boiling in the ink.

14. A recording apparatus according to claim 12, further comprising a casing for said mechanism section and said controlling section, wherein a sum of a width of said controlling section and a width of said carriage as measured in a scanning direction of said carriage is smaller than a whole width of said casing.

15. A recording apparatus according to claim 14, wherein said casing comprises a pair of recesses formed on opposite sides of a lower surface of said casing as hand grips, a central part of each of said recesses being located on a vertically extending plane passing through a center of gravity of said recording apparatus.

* * * * *

UNITED STATES PATENT AND TRADEMARK OFFICE

CERTIFICATE OF CORRECTION

PATENT NO. : 6,076,923

DATED : June 20, 2000

INVENTOR(S) : KASHIMURA ETAL.

It is certified that error appears in the above-identified patent and that said Letters Patent is hereby corrected as shown below:

On the title page: Item

[56] References Cited:

FOREIGN PATENT DOCUMENTS, "3142253" should read --3-142253-- and "4022670" should read --4-22670--.

COLUMN 5:

Line 7, "whole" should read --the whole--.

COLUMN 8:

Line 49, "tile" should read --the--.

Line 53, "especially," should read --especially--.

COLUMN 9:

Line 50, "ot" (both occurrences) should read --of--.

COLUMN 11:

Line 14, "control" should read --controlling--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*